US009388658B2

(12) United States Patent
Babbitt et al.

(10) Patent No.: US 9,388,658 B2
(45) Date of Patent: Jul. 12, 2016

(54) PIPE CUTTING APPARATUSES AND RELATED METHODS

(71) Applicant: TRANSOCEAN INNOVATION LABS, LTD, George Town (KY)

(72) Inventors: Guy Robert Babbitt, Fort Collins, CO (US); John Matthew Dalton, Missouri, TX (US)

( * ) Notice: Subject to any disclaimer, the term of this patent is extended or adjusted under 35 U.S.C. 154(b) by 0 days.

(21) Appl. No.: 14/527,729

(22) Filed: Oct. 29, 2014

(65) Prior Publication Data

US 2015/0122501 A1 May 7, 2015

Related U.S. Application Data

(60) Provisional application No. 61/896,998, filed on Oct. 29, 2013.

(51) Int. Cl.
*E21B 33/064* (2006.01)
*E21B 29/12* (2006.01)
*E21B 7/18* (2006.01)

(52) U.S. Cl.
CPC ..... *E21B 33/064* (2013.01); *E21B 7/185* (2013.01); *E21B 29/12* (2013.01)

(58) Field of Classification Search
CPC ..... E21B 29/00; E21B 29/002; E21B 29/08; E21B 29/007; E21B 29/12; E21B 7/185; E21B 7/122
USPC ..... 166/297, 298, 55.6; 451/76
See application file for complete search history.

(56) References Cited

U.S. PATENT DOCUMENTS

| | | | | |
|---|---|---|---|---|
| 2,265,082 | A * | 12/1941 | O'Neill | 451/75 |
| 2,525,391 | A * | 10/1950 | Bates | E21B 29/00 166/223 |
| 5,280,823 | A * | 1/1994 | Chabot | 166/55 |
| 2004/0089450 | A1 * | 5/2004 | Slade et al. | 166/298 |
| 2006/0254773 | A1 * | 11/2006 | Schlegelmilch et al. | 166/298 |
| 2012/0048535 | A1 * | 3/2012 | Ruttley et al. | 166/85.1 |

FOREIGN PATENT DOCUMENTS

| | | |
|---|---|---|
| GB | 2479472 | 10/2011 |
| WO | WO/2007/049026 | 5/2007 |

OTHER PUBLICATIONS

International Search Report and Written Opinion in International Application No. PCT/US2014/063007 dated Jan. 27, 2015.

* cited by examiner

*Primary Examiner* — James G Sayre
(74) *Attorney, Agent, or Firm* — Norton Rose Fulbright US LLP

(57) ABSTRACT

Some embodiments of the present subsea pipe cutting apparatuses use or include a frame, one or more water jet nozzles coupled to the frame and configured to apply pressurized fluid to a pipe to cut the pipe, and one or more of: a flange configured to secure the subsea pipe cutting apparatus relative to a blowout preventer stack, one or more water jet nozzles coupled to a rotating portion of the frame and configured to rotate about the pipe, one or more water jet nozzles movable between a retracted state and a deployed state in which the one or more water jet nozzles are radially closer to the pipe than when in the retracted state, one or more water jet nozzles pivotally coupled to the frame and configured to pivot while applying pressurized fluid to a surface of the pipe, and two or more water jet nozzles.

17 Claims, 19 Drawing Sheets

PIPE CUTTING APPARATUSES AND RELATED METHODS

CROSS-REFERENCE TO RELATED APPLICATIONS

This application claims priority to U.S. Provisional Application No. 61/896,998, filed on Oct. 29, 2013 and entitled "WATER JET SHEARING OF DRILL PIPES IN SUBSEA BLOWOUT PREVENTERS." The foregoing provisional patent application is incorporated by reference in its entirety.

BACKGROUND

1. Field of Invention

The present invention relates generally to apparatuses and methods suited for subsea pipe cutting, and more specifically, but not by way of limitation, to apparatuses and methods suited for subsea pipe cutting during subsea blowout preventer operations.

2. Description of Related Art

A blowout preventer is a mechanical device, usually installed redundantly in stacks, used to seal, control, and/or monitor a subsea well. Typically, a blowout preventer stack includes a number of devices, such as, for example, ram blowout preventers, annular blowout preventers, accumulators, test valves, failsafe valves, kill and/or choke lines and/or valves, riser joints, hydraulic connectors, and/or the like, many of which may be hydraulically actuated.

In some instances, a blowout preventer may be required to close an occupied wellbore (e.g., having an object disposed therein, such as, for example, a drill pipe, drill string, casing, and/or the like). In these instances, a blowout preventer can be configured to seal around an object disposed in the wellbore (e.g., a pipe ram blowout preventer, an annular blowout preventer, and/or the like) and/or shear the object (e.g., a shear ram blowout preventer, a blind shear ram blowout preventer, and/or the like).

Shearing an object disposed within a wellbore may be particularly effective during certain procedures, such as, for example, when it is desired to disconnect a lower marine riser package from a blowout preventer stack (or a portion of a blowout preventer stack), and/or the like. Shear-type blowout preventers may be a typical solution to shearing such an object; however, shear-type blowout preventers typically require a relatively high amount of closing power, and may also be relatively large and/or complex (e.g., and perhaps less reliable). And, if a shear-type blowout preventer fails to effectively shear the object (e.g., which may occur due to damage to the shear-type blowout preventer, object, and/or the like, caused by, for example, a well blowout, component malfunction, and/or the like), completion of a procedure (e.g., removal of a lower marine riser package from the blowout preventer stack) may suffer complications.

SUMMARY

Some embodiments of the present subsea pipe cutting apparatuses are configured, through one or more water jet nozzles coupled to a frame and configured to apply pressurized fluid to a pipe to cut the pipe, to cut a pipe disposed within a wellbore of a blowout preventer (e.g., accomplishing, at least in part, the shearing functionality of a shear-type blowout preventer, in some instances with reduced power consumption, cost, size, weight, complexity, and/or the like). Some embodiments are configured to achieve and/or enhance such desirable functionality through one or more of: one or more water jet nozzles coupled to a rotating portion of the frame and configured to rotate about the pipe, one or more water jet nozzles movable between a retracted state and a deployed state in which the water jet nozzles are radially closer to the pipe than when in the retracted state, one or more water jet nozzles pivotally coupled to the frame and configured to pivot while applying pressurized fluid to a surface of the pipe, and two or more water jet nozzles.

Some embodiments of the present subsea pipe cutting apparatuses are configured, through a flange configured to secure the apparatus relative to a blowout preventer stack, to readily integrate and/or interface with, replace, and/or the like typical blowout preventers and/or components thereof, blowout preventer stacks and/or components thereof, and/or the like.

Some embodiments of the present subsea pipe cutting apparatuses for use in a blowout preventer stack comprise a frame and one or more water jet nozzles coupled to the frame and configured to apply pressurized fluid to a pipe to cut the pipe. In some embodiments, the one or more water jet nozzles comprises two or more water jet nozzles. In some embodiments, the one or more water jet nozzles comprises four or more water jet nozzles. Some embodiments comprise a flange configured to secure the subsea pipe cutting apparatus relative to a blowout preventer stack. In some embodiments, the pipe comprises a drill pipe. In some embodiments, the pipe comprises a casing.

In some embodiments, the frame comprises a stationary portion and a rotating portion and the water jet nozzle(s) are coupled to the rotating portion of the frame. "Water jet nozzle (s)" may mean a single water jet nozzle when it refers to "one or more water jet nozzles." In some embodiments, actuation of the water jet nozzle(s) causes rotation of the rotating portion of the frame relative to the stationary portion of the frame. Some embodiments comprise a flange configured to secure the stationary portion of the frame relative to a blowout preventer stack.

In some embodiments, the water jet nozzle(s) are movable between a retracted state and a deployed state in which the water jet nozzle(s) are radially closer to the pipe than when in the retracted state. Some embodiments comprise one or more actuators configured to move the water jet nozzle(s) from the retracted state the deployed state.

In some embodiments, rotation of the rotating portion of the frame relative to the stationary portion of the frame causes the water jet nozzle(s) to move between the retracted state and the deployed state. Some embodiments comprise a first linkage having a first end coupled to one of the water jet nozzle(s) and a second end pivotally coupled to the stationary portion of the frame, and a second linkage having a first end coupled to the one of the water jet nozzle(s) and a second end pivotally coupled to the rotating portion of the frame, where rotation of the rotating portion of the frame relative to the stationary portion of the frame causes the first end of the first linkage and the first end of the second linkage to displace radially towards the pipe.

In some embodiments, the rotating portion of the frame comprises a first portion and a second portion configured to rotate relative to the first portion, and the one or more water jet nozzle(s) are coupled to the second portion of the frame. In some embodiments, actuation of the water jet nozzle(s) causes rotation of the second portion of the frame relative to the first portion of the frame.

In some embodiments, rotation of the second portion of the frame relative to the first portion of the frame causes the water jet nozzle(s) to move between the retracted state and the deployed state. Some embodiments comprise a first linkage having a first end coupled to one of the water jet nozzle(s) and a second end pivotally coupled to the first portion of the frame, and a second linkage having a first end coupled to the one of the water jet nozzle(s) and a second end pivotally coupled to the second portion of the frame, where rotation of the second portion of the frame relative to the first portion of the frame causes the first end of the first linkage and the first end of the second linkage to displace radially towards the pipe.

In some embodiments, each of the water jet nozzle(s) comprises a stop configured to contact the pipe when the water jet nozzle is in the deployed state. In some embodiments, each stop comprises a roller configured to contact the pipe when the water jet nozzle is in the deployed state.

In some embodiments, the water jet nozzle(s) are pivotally coupled to the frame such that each water jet nozzle can be pivoted while applying pressurized fluid to a surface of the pipe.

Some embodiments comprise a pump configured to supply at least a portion of the pressurized fluid to the water jet nozzle(s). Some embodiments comprise a reservoir configured to supply an abrasive to at least a portion of the pressurized fluid.

Some embodiments of the present methods for cutting a subsea pipe comprise applying pressurized fluid to the pipe with one or more water jet nozzles to cut the pipe, where the one or more water jet nozzles are coupled to a frame, the frame coupled to a blowout preventer stack via a flange. Some embodiments comprise moving the one or more water jet nozzles from a retracted state to a deployed state in which the water jet nozzles are radially closer to the pipe than when in the retracted state. Some embodiments comprise moving the one or more water jet nozzles circumferentially around the pipe. Some embodiments comprise pivoting the one or more water jet nozzles while applying pressurized fluid to a surface of the pipe.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

FIG. 2B is a magnified view of a portion of FIG. 2A, and FIG. 2C is a magnified view of a portion of FIG. 2B.

DETAILED DESCRIPTION OF ILLUSTRATIVE EMBODIMENTS

Figure 1:
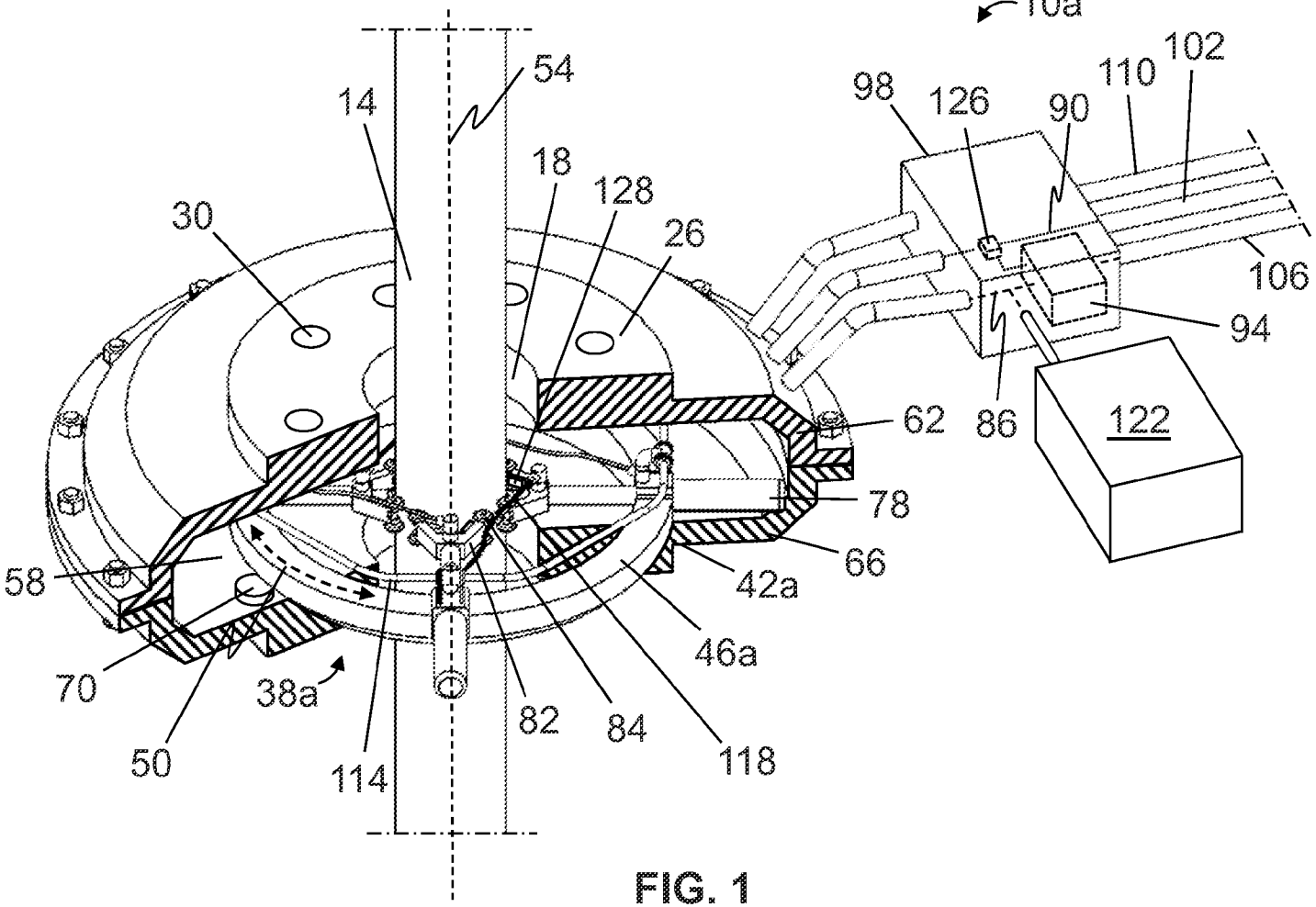
FIG. 1 is a partially cutaway perspective view of a first embodiment of the present subsea pipe cutting apparatuses.
Figures 2A, 2B, 2C:
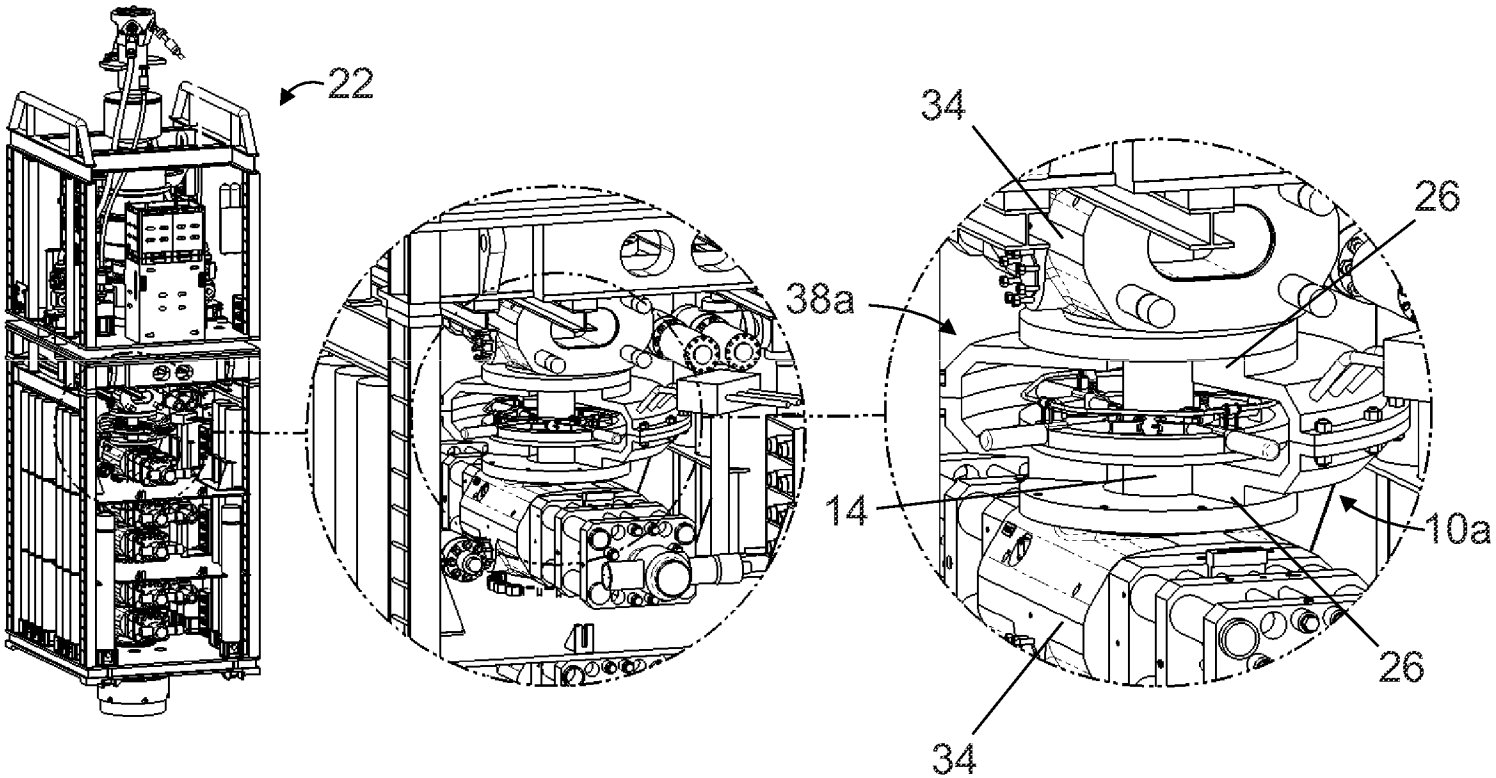
FIGS. 2A to 2C and 3 are partially cutaway perspective views of the embodiment of FIG. 1 coupled to a blowout preventer stack. In particular.
Figure 3:
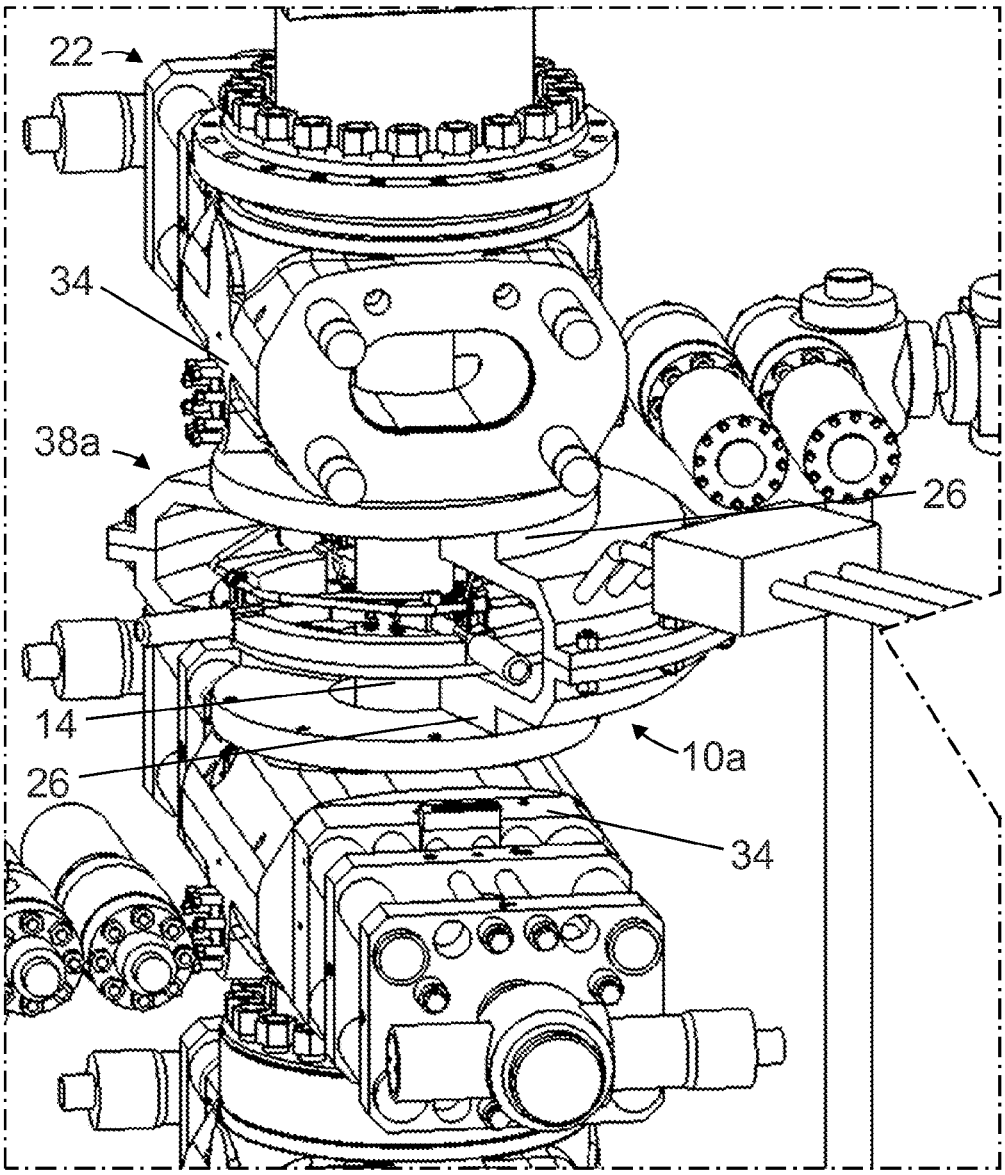
Figure 4:
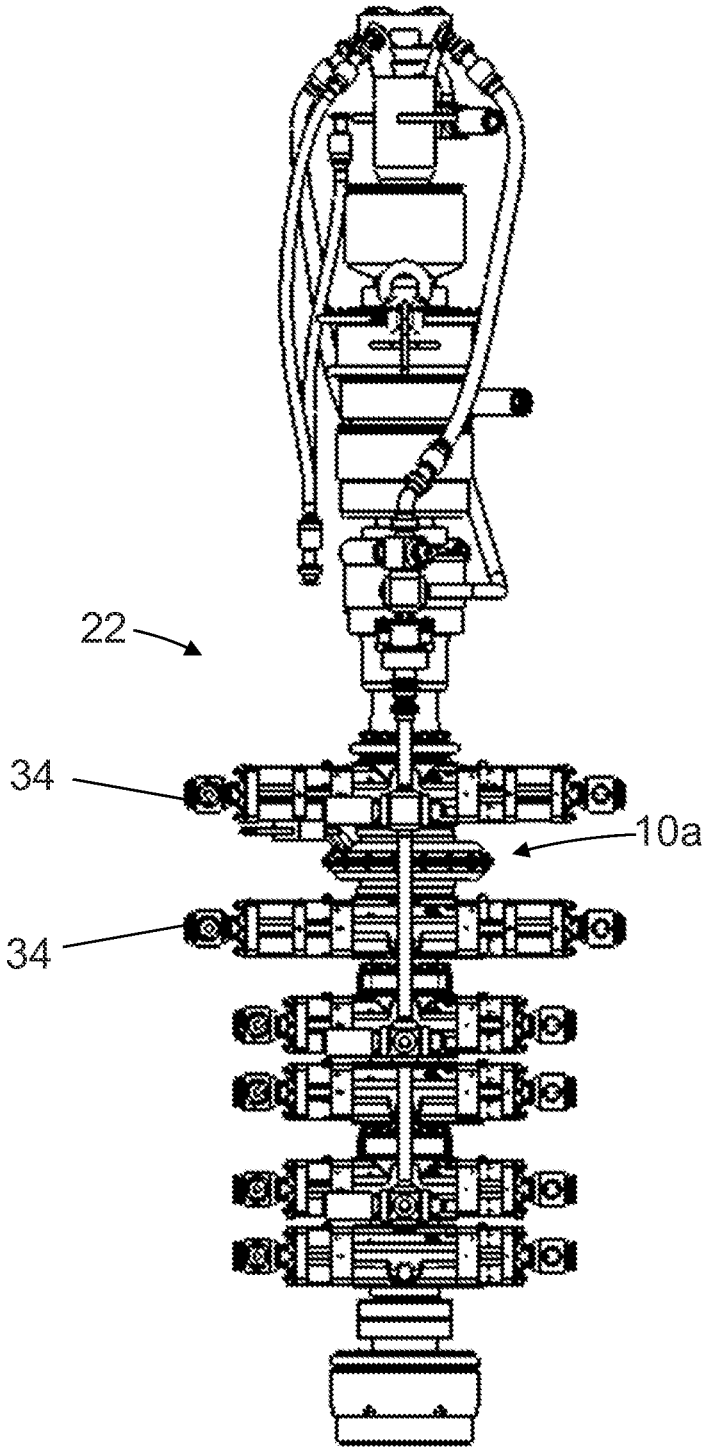
FIGS. 4 and 5 are side views of the embodiment of FIG. 1 coupled to a blowout preventer stack.
Figure 5:
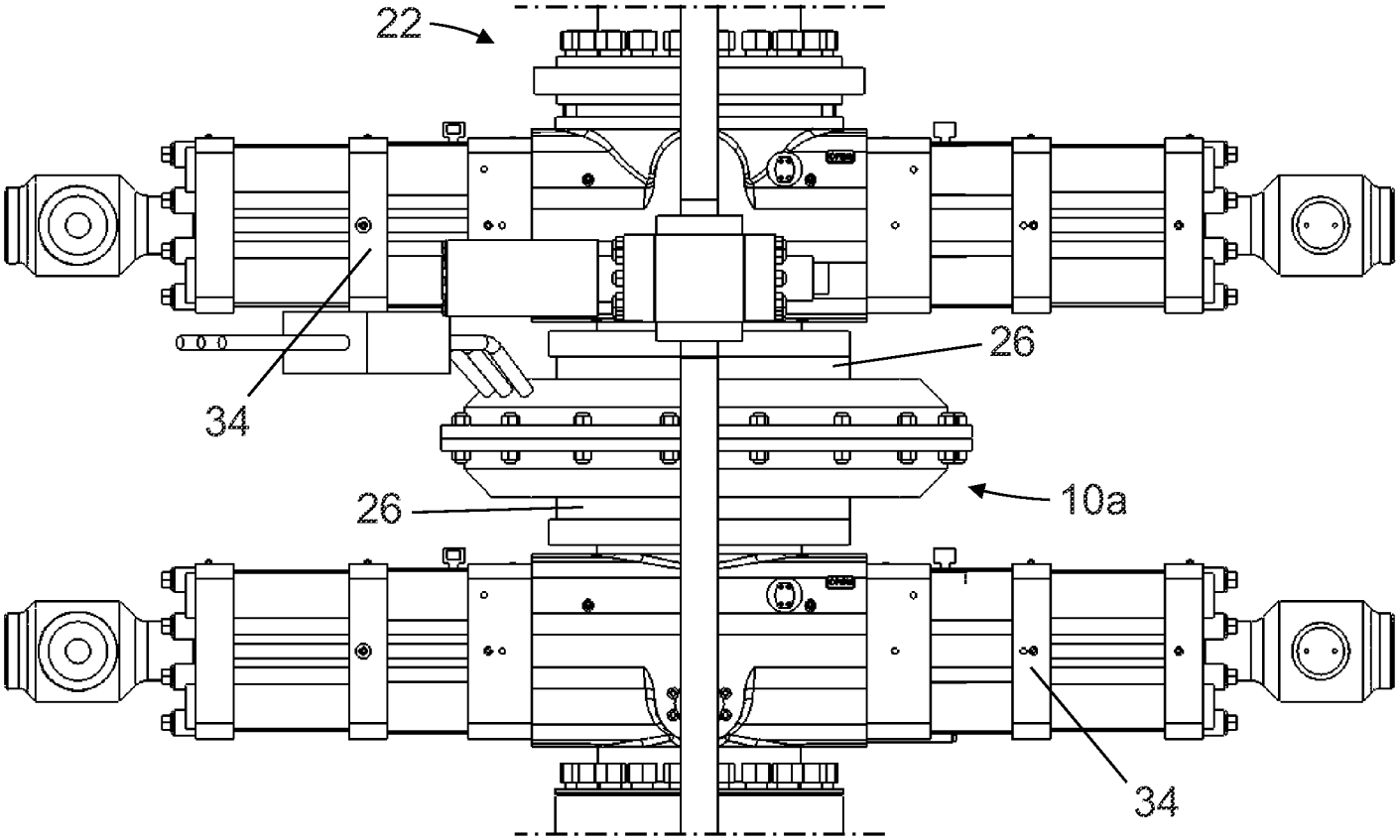

Referring now to the drawings, and more particularly to FIGS. 1-7, shown therein and designated by the reference numeral 10*a* is a first embodiment of the present subsea pipe cutting apparatuses. In the embodiment shown, apparatus 10*a* is configured to cut a pipe 14 (e.g., a drill pipe, which may be disposed within a portion of a wellbore 18 and configured to convey drilling fluids to, from, and/or through the wellbore, transmit torque to a drill bit, and/or the like). Pipe 14 (e.g., a drill pipe) is provided only by way of example, as the present pipe cutting apparatuses can be configured to cut any suitable pipe, tube, conduit, and/or the like, including, but not limited to, drill pipes, casings, risers, strings, and/or the like, combinations thereof (e.g., a drill pipe disposed within a casing), whether or not such pipe(s), tube(s), conduit(s), and/or the like are disposed within a wellbore (e.g., 18), blowout preventer (e.g., 34), blowout preventer stack (e.g., 22), and/or the like. At least through the ability to cut a pipe, the present pipe cutting apparatuses can facilitate certain procedures (e.g., removal of a lower marine riser package from a blowout preventer stack), operation of other blowout preventer components (e.g., actuation of shear-type rams, for example, by compromising the strength of pipe 14 by cutting the pipe), and/or the like.

In this embodiment, apparatus 10*a* is configured for use in a blowout preventer stack (e.g., an assembly of blowout preventers and other components) (e.g., 22, best shown in FIGS. 2A-2C and 3-5). For example, in the depicted embodiment, apparatus 10*a* comprises a flange 26 configured to secure the subsea pipe cutting apparatus relative to blowout preventer stack 22. By way of illustration, in the embodiment shown, flange 26 comprises a plurality of holes 30 configured to receive fasteners (e.g., bolts, rivets, and/or the like) to secure apparatus 10*a* relative to blowout preventer stack 22 and/or a component thereof (e.g., ram-type blowout preventer 34, as shown). In this embodiment, apparatus 10*a* is depicted as disposed between two ram-type blowout preventers 34, each coupled to apparatus 10*a* via a flange 26 (e.g., in the depicted embodiment, apparatus 10*a* comprises two (2) flanges 26). However, in other embodiments, the present apparatuses can be disposed at any suitable location, whether or not within a blowout preventer stack (e.g., secured to a pipe outside of a blowout preventer stack).

In the depicted embodiment, apparatus 10*a* comprises a frame 38*a* (e.g., which, in some embodiments, may be referred to as a body, housing, and/or the like) (e.g., a structure for locating components of apparatus 10*a* relative to one another). In the embodiment shown, frame 38*a* comprises a stationary portion 42*a* and a rotating portion 46*a*, which is configured to rotate relative to the stationary portion (e.g., generally along a direction indicated by arrow 50 about a longitudinal axis 54 of the apparatus, but not necessarily of pipe 14). Stationary portion 42*a* may be stationary in that the stationary portion may, during use, be fixed relative to blowout preventer stack 22 and/or pipe 14. In this embodiment, stationary portion 42*a* defines an interior volume 58 configured to receive rotating portion 46*a* such that the stationary portion substantially encloses the rotating portion. In this way, stationary portion 42*a* may be configured to prevent undesired fluid ingress and/or egress to and/or from interior volume 58 (e.g., to prevent fluid from leaking from the interior volume and into a subsea environment and/or prevent sea water from entering the interior volume from the subsea environment). In the depicted embodiment, stationary portion 42*a* is generally defined by a first frame member 62 and a second frame member 66 coupled (e.g., removably and/or sealingly) to the first frame member. Such multi-piece frame assemblies (e.g., 38*a*) may facilitate assembly, maintenance, repair and/or replacement of apparatus 10*a* and/or components thereof.

In the embodiment shown, rotation of rotating portion 46*a* relative to stationary portion 42*a* can be facilitated by an actuator 70 (e.g., a motor, which may be coupled to rotating portion 46*a* through, for example, a gear assembly), whether actuated electrically (e.g., via electrical power communicated through conduit 102, described in more detail below), hydraulically (e.g., via pressurized fluid), pneumatically, and/or the like. In such embodiments, control of actuator 70 may be based, at least in part, on data captured by one or more sensors 128 (described in more detail below). For example, in some embodiments, material thickness measuring sensor(s) 128 may capture data indicative of pipe 14 wall thickness, and actuator 70 may be controlled (e.g., by a processor 126) to cause rotating portion 46*a* to rotate more slowly as water jet nozzle(s) 74 are actuated to cut relatively thicker materials as indicated in the data captured by the sensor(s), and more quickly when the water jet nozzle(s) are actuated to cut relatively thinner materials as indicated in the data captured by the sensor(s).

In some embodiments, rotation of the rotating portion relative to the stationary portion may be facilitated by actuation of water jet nozzle(s) 74 (e.g., which may be coupled to rotating portion 46*a* and configured impart a moment to the rotating portion by ejecting a stream of pressurized fluid in a direction having a non-radial component relative to longitudinal axis 54). However, in other embodiments, rotating portion 46*a* may be omitted, and water jet nozzle(s) 74 may be coupled to stationary portion 42*a*.

In this embodiment, one or more water jet nozzles 74 (best shown in FIGS. 6A-6C and 7A-7C) are configured to apply pressurized fluid to pipe 14 to cut the pipe. In the depicted embodiment, apparatus 10*a* comprises four (4) water jet nozzles 74. However, in other embodiments, the present apparatuses can comprise any suitable number of water jet nozzle(s), such as, for example, greater or equal to any one of, or between any two of: 1, 2, 3, 4, 5, 6, 7, 8, 9, 10, 12, 14, 16, 18, 20, 25, 30, 35, 40, 50, or more water jet nozzle(s). As used in this disclosure, the term "pressurized fluids" includes, but is not limited to, fluids, fluids containing particulate matter (e.g., abrasives), and/or the like. For example, suitable pressurized fluids include water, seawater, hydraulic fluid, and/or the like, and may include abrasives (e.g., garnet and/or the like). Pressurized fluids can have a pressures ranging from 30,000 pounds per square inch (psi) to 100,000 (psi) or greater.

As shown in FIGS. 6A-6C and FIGS. 7A-7C, in this embodiment, water jet nozzle(s) 74 are movable (e.g., generally along a direction indicated by arrow 76) between a retracted state (e.g., FIGS. 6A and 7A) and a deployed state (e.g., FIGS. 6C and 7C) in which the water jet nozzle(s) are radially closer to longitudinal axis 54 and/or pipe 14 than when in the retracted state. In the embodiment shown, such movement can be facilitated by one or more actuators 78. In this embodiment, each actuator is configured to move a single water jet nozzle 74 between its retracted and deployed states; however, in other embodiments, each actuator can be configured to move multiple water jet nozzles between the retracted state and the deployed state (e.g., 2, 3, 4, 5, 6, 7, 8, 9, 10, 12, 14, 16, 18, 20, or more water jet nozzles). In some embodiments, water jet nozzle(s) 74 and/or actuator(s) 78 may be biased towards the retracted state (e.g., by or as if by a spring). Actuator(s) 78 of the present subsea pipe cutting apparatuses can comprise any suitable actuator(s), whether powered electrically, hydraulically, pneumatically, and/or the like. For example, in some embodiments, actuator(s) 78 may be configured such that flow of pressurized fluid to water jet nozzle (s) 74 and/or other components of the subsea pipe cutting apparatus may cause the actuator(s) to actuate to move water jet nozzle(s) 74 from the retracted state the deployed state.

As shown, in this embodiment, each of water jet nozzle(s) 74 comprises a stop 82 configured to contact pipe 14 when the water jet nozzle is in the deployed state (e.g., and thus may set the minimum distance between the pipe and the water jet nozzle). In the depicted embodiment, each stop 82 comprises a roller 84 configured to contact the pipe when the water jet nozzle is in the deployed state. In this way, roller(s) 84 may facilitate smooth rotation of rotating portion 46*a* when water jet nozzle(s) 74 are in the deployed state (e.g., during cutting).

In the embodiment shown, each water jet nozzle 74 can be deployed to a distance relative to pipe 14 (e.g., such that stop 82 and/or roller 84 contacts the pipe), regardless of the orientation of pipe 14 relative to the apparatus, wellbore 18, and/or the like. In this way, for example, in the event that pipe 14 has buckled and/or otherwise moved within wellbore 18 (e.g., has moved from an expected orientation), each water jet nozzle 74 may nevertheless be deployed to a distance relative to the pipe 14 (e.g., with a stop 82 and/or roller 84 in contact with the pipe), and, perhaps assisted by a stop 82 and/or roller 84, may maintain the distance relative to the pipe during rotation (e.g., in a similar fashion to a cam follower riding on a cam) (e.g., by moving towards and/or away from longitudinal axis 54, generally along a direction indicated by arrow 76, as rotating portion 46*a* rotates).

In some embodiments, water jet nozzle(s) 74 can be pivotally coupled to a frame (e.g., 38*a*) or portion thereof (e.g., 42*a*, 46*a*) such that each water jet nozzle can be pivoted while applying pressurized fluid to a surface of pipe 14. For example, in some embodiments, water jet nozzle(s) 74 may be coupled relative to a frame or portion thereof via a pivoting, swiveling, and/or the like connection (e.g., similarly to second ends of linkages 138 and 150, described in more detail below). In some embodiments, such pivoting, swiveling, and/or the like can be controlled by actuators (e.g., electric, hydraulic, pneumatic, and/or the like actuators). In this way, pressurized fluid can be applied across a surface of pipe 14 (e.g., in a sweeping fashion), which may, in some instances, enhance pipe cutting operation (e.g., by reducing a number of water jet nozzle(s) 74, an angle of rotation, for example, of a rotating portion 46*a*, and/or the like required to cut a pipe).

Some of the features described below are drawn in the figures schematically (e.g., pump 94, housing 98, reservoir 122, processor 126, one or more sensors 128), and thus may not be drawn to scale for all embodiments of the present subsea pipe cutting apparatuses. In the following description, provided only by way of example, fluid communication may be generally indicated by dashed lines 86, and electrical communication may be generally indicated by dotted lines 90.

In the embodiment shown, apparatus 10*a* comprises a pump 94 configured to supply at least a portion of the pressurized fluid to water jet nozzle(s) 74. By way of example, in the depicted embodiment, pump 94 comprises an intensifier and/or intensifier pump. Pumps of the present disclosure can be actuated in any suitable fashion, whether electrically, hydraulically, pneumatically, and/or the like. Some embodiments of the present subsea pipe cutting apparatuses may comprise multiple pumps 94, such as, for example, 2, 3, 4, 5, 6, 7, 8, 9, 10, 12, 14, 16, 18, 20, or more pumps. In such embodiments, the hydraulic power required to provide pressurized fluid sufficient to cut a pipe may be distributed across multiple pumps, thus reducing the power required to actuate any given one of the pumps.

In the embodiment shown, pump 94 is disposed within a housing 98, which may be pressure-compensated (e.g., having an internal pressure equal to or greater than a pressure within a subsea environment, such as, for example, 5 to 7 psi gauge (psig) greater). In this way, pump 94 and/or associated components may be protected from a subsea environment.

In embodiments with an electrically actuated pump 94, electrical power for actuating the pump may come from any suitable power source, such as, for example, one or more batteries (not expressly shown), which may be disposed within housing 98 and/or at any other suitable subsea or above sea location, electrical communication with an auxiliary cable (e.g., via electrical wiring disposed within an electrical conduit 102), and/or the like. In some embodiments, other components (e.g., actuators, such as, for example, actuator(s) 70, actuator(s) 78, and/or the like), if electrically actuated, can receive power in a same or substantially similar fashion.

In the embodiment shown, pump 94 may receive fluid through a conduit 106. In the present subsea pipe cutting apparatuses, fluid may be provided from any suitable source, such as, for example, a pumping assembly, reservoir, accumulator, and/or the like, whether disposed subsea or above sea, a hot line and/or rigid conduit connected to a surface pressure source (e.g., a hydraulic power unit), and/or the like.

In the depicted embodiment, fluid pressurized by pump 94 can be communicated to a fluid rail 114 (e.g., via a flexible supply line), from which the pressurized fluid can be supplied to each of water jet nozzle(s) 74. In this embodiment, each water jet nozzle is configured to receive pressurized fluid via a flexible line 118. In the depicted embodiment, flexible lines 118 may be used to account for movement of water jet nozzle (s) 74, such as, for example, during rotation about longitudinal axis 54, during movement between the retracted state and the deployed state, during pivotal movement relative to frame 38*a* and/or a portion thereof, and/or the like. However, in other embodiments, pressurized fluid may communicated to the water jet nozzle(s) in any suitable fashion and via any suitable structure, such as, for example, through internal conduits (e.g., within a frame 38*a* and/or a portion thereof, such as, for example, a rotating portion 46*a*, stationary portion 42*a*, and/or the like), rigid lines, tubes, conduits, and/or the like, and/or the like.

In the depicted embodiment, apparatus 10*a* comprises a reservoir 122 configured to supply an abrasive to at least a portion of the pressurized fluid. Abrasives suitable for use in the present subsea pipe cutting apparatuses can comprise any suitable abrasive, such as, for example, garnet, and/or the like, and may be pumped from the surface, stored subsea (e.g., in reservoir 122), and/or the like. In some embodiments, reservoir 122 may be disposed above other components of a subsea pipe cutting apparatus (e.g., such that gravity assists introduction of abrasive into a portion of pressurized fluid).

The present subsea pipe cutting apparatuses can be controlled in any suitable fashion, whether open loop, closed loop (e.g., based on feedback from sensors), and/or the like. For example, in this embodiment, apparatus 10*a* comprises a processor 126 configured to control actuation of apparatus 10*a* and/or components thereof (e.g., actuators, such as, for example, actuator(s) 70, actuator(s) 78, pumps, such as, for example, pump(s) 94, and/or the like). While in this embodiment, processor 126 is depicted as forming part of apparatus 10*a* (e.g., processor 126 is disposed within housing 98), in other embodiments, processor 126 may be disposed at any suitable location, whether subsea or above sea, and may communicate with apparatus 10*a* and/or components thereof, for example, via electrical communication through conduit 102, a (e.g., dedicated) communications conduit 110, and/or the like.

In some embodiments, processor 126 can be configured to control apparatus 10*a* in an open loop fashion (e.g., by executing received commands, commands stored in a memory (not expressly shown), and/or the like). For example, processor 126 can receive a command from an above sea controller to cut pipe 14 (e.g., communicated through a conduit 102 and/or 110), and in turn, processor may command actuator(s) 78 to move water jet nozzle(s) 74 to the deployed state, command pump(s) 94 to supply pressurized fluid to the water jet nozzle (s), command actuator 70 to cause rotation of rotating portion 46*a* of frame 38*a* to rotate relative to stationary portion 42*a*, and/or the like. In some embodiments, processor 126 can be configured to automatically actuate apparatus 10*a* in certain circumstances. For example, in the event that processor 126 detects a loss of communications (e.g., through conduit 102 and/or 110) and/or power (e.g., through conduit 102), processor 126 may command actuator(s) 78 to move water jet nozzle (s) to the deployed state, command pump(s) 94 to supply pressurized fluid to the water jet nozzle(s), command actuator 70 to cause rotation of rotating portion 46*a* of frame 38*a* to rotate relative to stationary portion 42*a*, and/or the like (e.g., using power supplied by one or more batteries in the event of a loss of power).

In some embodiments, processor 126 can control apparatus 10*a* based, at least in part, on data captured by one or more sensors 128 (e.g., in a closed loop fashion). For example, in some embodiments, processor 126 can receive data captured by one or more sensors 128 (e.g., indicative of wellbore 18 pressure), and command actuation of water jet nozzle(s) 74, actuator(s) (e.g., 70, 78, and/or the like), pump(s) 94, and/or the like to cut pipe 14 (e.g., if the data captured by the one or more sensors indicates a well blowout, blowout preventer malfunction, and/or the like). For another example, in some embodiments, one or more of sensor(s) 128 may comprise a material thickness measuring sensor (e.g., an x-ray, ultrasonic, capacitive, and/or the like material thickness measuring sensor) configured to capture data indicative of material thickness. In such embodiments, processor 126 can receive the data captured by the sensor(s), and control, based at least in part on the data, actuation of water jet nozzle(s) 74, actuators(s) (e.g., 70, 78, and/or the like), pump(s) 94, and/or the like. For example, if the data captured by the sensor(s) indicates a thicker material, processor 126 may command actuator 70 to move one or more water jet nozzles at a slower speed around pipe 14, command pump(s) 94 to supply pressurized fluid at a higher pressure to the water jet nozzle(s), and/or the like, than when the data captured by the sensor(s) indicates a thinner material.

In some embodiments, apparatus 10*a* can communicate with other components, such as, for example, ram-type blowout preventers 34, surface control components, and/or the like to perform system-level (e.g., blowout preventer stack 22) operations.

FIGS. 8-14 depict a second embodiment 10*b* of the present pipe cutting apparatuses. Pipe cutting apparatus 10*b* is substantially similar to pipe cutting apparatus 10*a*, with the primary exception being how water jet nozzle(s) 74 move from a retracted state (e.g., FIGS. 13A and 14A) to a deployed state (e.g., FIGS. 13C and 14C), as described below. Otherwise, subsea pipe cutting apparatus 10*b* can comprise any and/or all of the features described above for subsea pipe cutting apparatus 10*a*.

For example, in the embodiment shown, rotating portion 46*b* of frame 38*b* comprises a first portion 130 and a second portion 134, the second portion configured to rotate relative to the first portion (e.g., such that first portion 130 and second portion 134 can each rotate relative to stationary portion 42*b*). In this embodiment, rotation of second portion 134 relative to first portion 130 (e.g., generally along a direction indicated by arrow 136 about longitudinal axis 54) causes water jet nozzle (s) 74 to move between the retracted state and the deployed state. However, in other embodiments, rotating portion 46*b* may not comprise a second portion configured to rotate relative to a first portion, and instead, rotation of rotating portion 46*b* relative to stationary portion 42*b* may cause water jet nozzle(s) 74 to move between the retracted state and the deployed state. In the embodiment shown, rotation of second portion 134 relative to first portion 130 and/or relative to stationary portion 42*b* can be accomplished in any suitable fashion (e.g., by actuation of water jet nozzle(s), actuation of one or more actuator(s) (e.g., 70), and/or the like, similarly to as described above for apparatus 10*a*).

Provided by way of illustration, in the depicted embodiment, apparatus 10*b* comprises a first linkage 138 having a first end 142 coupled to one of water jet nozzle(s) 74 and a second end 146 pivotally coupled to first portion 130 of frame 38*b*, and a second linkage 150 having a first end 154 coupled to the one of the water jet nozzle(s) and a second end 158 pivotally coupled to second portion 134 of the frame, where rotation of the second portion of the frame relative to the first portion of the frame causes the first end of the first linkage and the first end of the second linkage to displace radially towards the pipe (displacement best shown in FIGS. 13A-13C and 14A-14C). In this embodiment, first portion 134 can be configured to limit pivotal movement of second end 146 of first linkage 138 relative to the first portion (e.g., as shown, via a plurality of protrusions 160 disposed on rotating portion 46*b*).

As mentioned above, in some embodiments, rotating portion 46*b* may not comprise a first portion and a second portion, and rotation of rotating portion 46*b* relative to stationary portion 42*b* may cause water jet nozzle(s) 74 to move between the retracted state and the deployed state. In these embodiments, for example, a first linkage (e.g., 138) may have a first end (e.g., 142) coupled to one of water jet nozzle (s) 74 and a second end (e.g., 146) pivotally coupled to a stationary portion (e.g., 42*b*), a second linkage (e.g., 150) may have a first end (e.g., 154) coupled to the one or the water jet nozzle(s) and a second end (e.g., 158) pivotally coupled to a rotating portion (e.g., 46*b*) of the frame, where rotation of the rotating portion of the frame relative to the stationary portion of the frame causes the first end of the first linkage and the second end of the second linkage to displace radially towards the pipe (e.g., in a similar fashion as to described above).

Figure 15B:
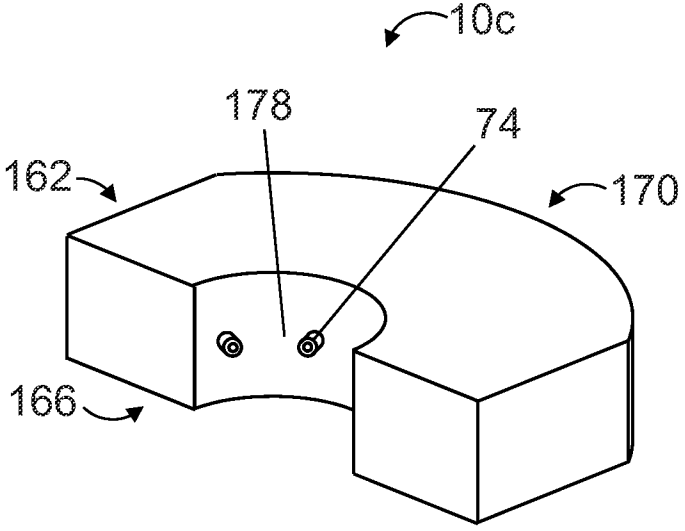
FIG. 15B is a perspective view of a ram of FIG. 15A.
Figure 15A:
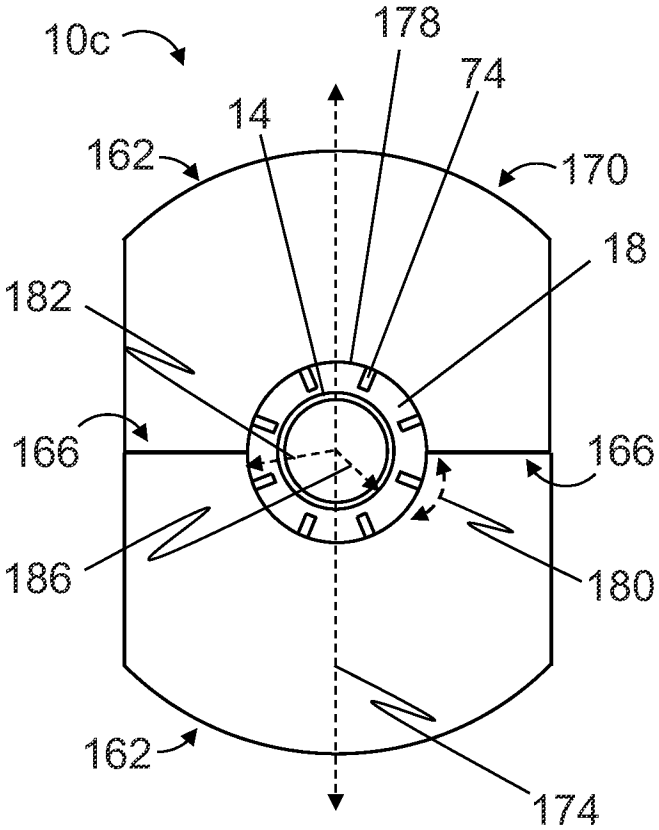
FIG. 15A is a top view of two rams of a third embodiment of the present subsea pipe cutting apparatuses.

FIGS. 15A and 15B depict rams 162 of a third embodiment 10*c* of the present subsea pipe cutting apparatuses. In the embodiment shown, apparatus 10*c* (e.g., or rams 162 thereof) is configured to replace one or more existing rams (e.g. within a ram blowout preventer) and, in some embodiments, may comprise one or more existing rams modified with the following features. For example, in this embodiment, each ram 162 comprises a first end 166, at least a portion of which is configured to interface with a first end 166 of another ram 162 (e.g., as shown in FIG. 15A). Typically, such rams may be actuated to close a wellbore (e.g., 18). For example, in this embodiment, two (2) rams 162 are configured to move relative to one another (e.g., generally along a direction indicated by arrow 174) (e.g., via a force supplied by hydraulic pistons and applied generally at a second end 170) until each ram interfaces with the other at respective first ends 166 (e.g., which, in some embodiments, may seal wellbore 18). While two (2) rams 162 are depicted in this embodiment, other embodiments of the present subsea pipe cutting apparatuses can comprise any suitable number of rams, such as, for example, 3, 4, 5, 6, 7, 8, 9, 10, or more rams.

In the embodiment shown, first end 166 of each ram defines a recess 178 configured to receive at least a portion of pipe 14 such that rams 162 may interface with one another at respective first ends 166 substantially without interference from pipe 14 (e.g., without crushing the pipe) (e.g., rams 162 comprise and/or are similar to a pipe ram, but recess 178 need not be circular). While rams 162 of the depicted embodiment comprise and/or are similar to a pipe ram, in other embodiments, rams 162 may comprise and/or be similar to a ram, shear ram, and/or the like (e.g., and first ends 166 of such rams may or may not comprise a recess 178).

In the embodiment shown, one or more water jet nozzles 74 are coupled to each ram 162 (e.g., at first end 166 within recess 178) (e.g., pivotally coupled such that each of water jet nozzle(s) 74 can be pivoted, for example, generally along a direction indicated by arrow 180, while applying pressurized fluid to a surface of pipe 14). In this embodiment, each recess 178 is dimensioned such that when rams 162 interface with one another at respective first ends 166, a portion of the first end of each ram within recess 178 does not contact pipe 14 (e.g., each recess 178, which in this embodiment is generally circular, has an average radius 182 larger than an average outer radius 186 of pipe 14). In this way, at least a portion of each water jet nozzle 74 may occupy a volume defined between pipe 14 and interfacing rams 162 (e.g., and each water jet nozzle 74 may be deployable to and/or retractable from such a position, for example, in a same or similar fashion as to described above for apparatus 10*a*). However, in other embodiments, each ram 162 may be configured such that nozzle(s) 74 are substantially disposed within the ram and/or disposed within indentations, notches, and/or the like of first end 166 and/or recess 178 (e.g., and a portion of the first end 166 of each ram within recess 178 may be configured to interface with pipe 14, in a similar fashion as to a traditional pipe ram) (e.g., having a recess 178 with an average radius 182 that is substantially equal to an average outer radius 186 of pipe 14).

With the exception of some additional features described above, subsea pipe cutting apparatus 10*c* and similar embodiments may comprise any and/or all of the features described above for subsea pipe cutting apparatus 10*a* and/or 10*b* (e.g., actuator(s) 78, stop(s) 82, roller(s) 84, pump(s) 94, housing 98, conduits 102, 106, and/or 110, fluid rail 114, flexible line(s) 118, reservoir 122, processor 126, and/or the like). In some embodiments, various components may be defined by and/or contained within a ram 162 (e.g., actuator(s) 78, fluid rail 114, flexible line(s) 118, internal conduits for providing pressurized fluid to water jet nozzle(s) 74, and/or the like).

Figure 6A:
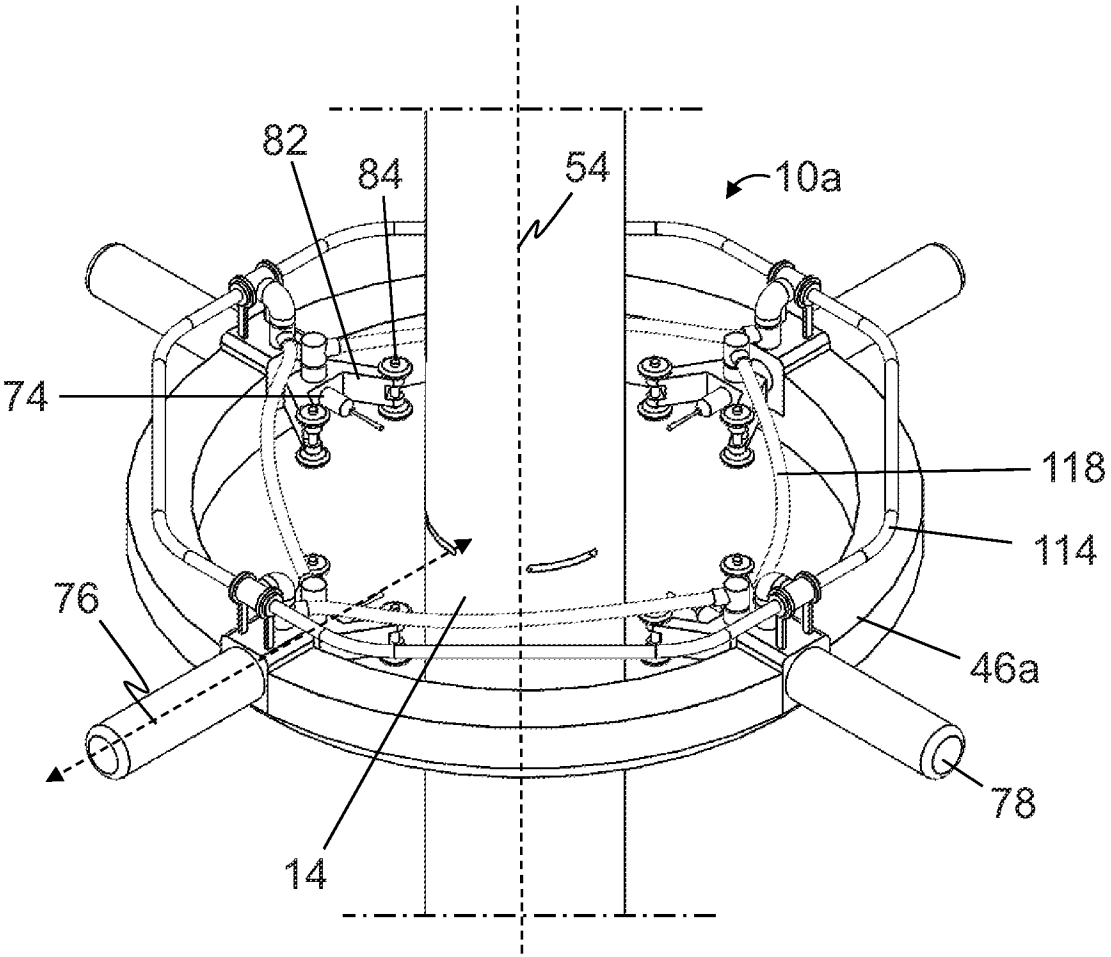
FIGS. 6A-6C are partially cutaway perspective views of the embodiment of FIG. 1, depicting an example of water jet nozzle movement from a retracted state to a deployed state.
Figure 6C:
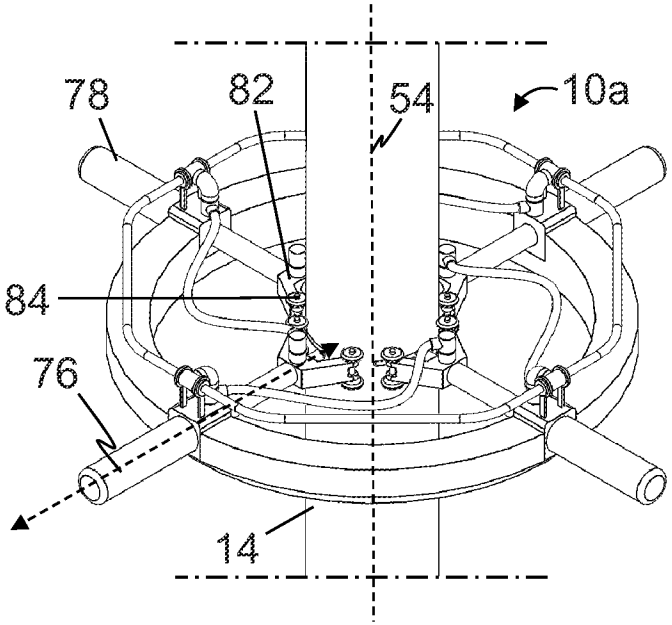
Figure 6B:
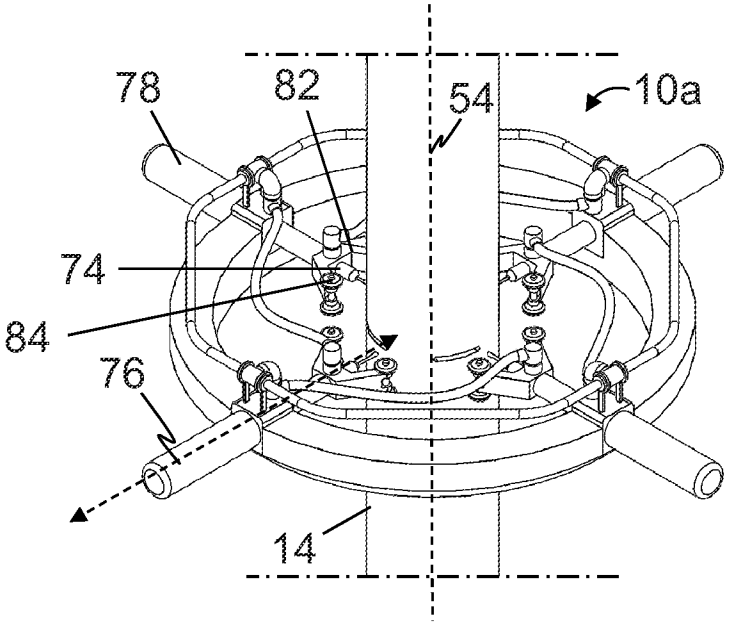
Figure 7A:
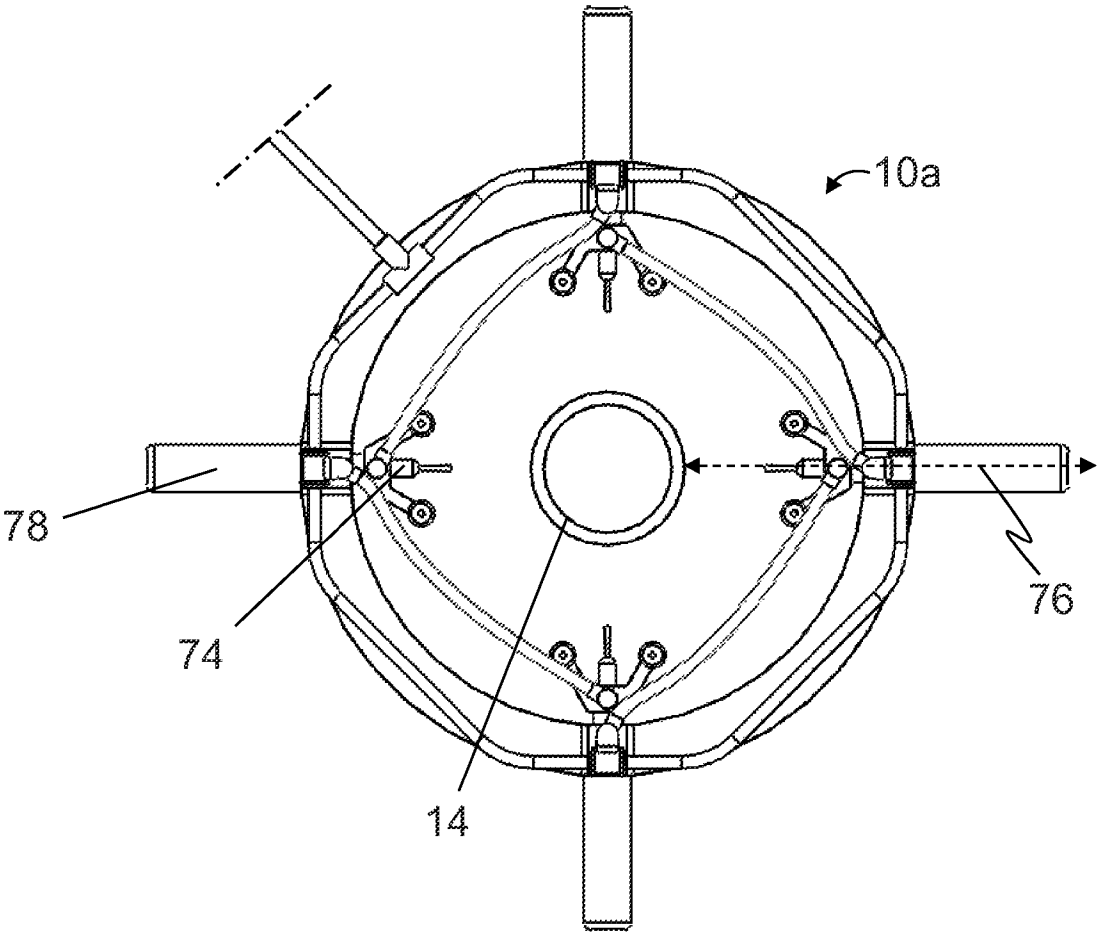
FIGS. 7A-7C are partially cutaway top views of the embodiment of FIG. 1, depicting an example of water jet nozzle movement from a retracted state to a deployed state.
Figure 7C:
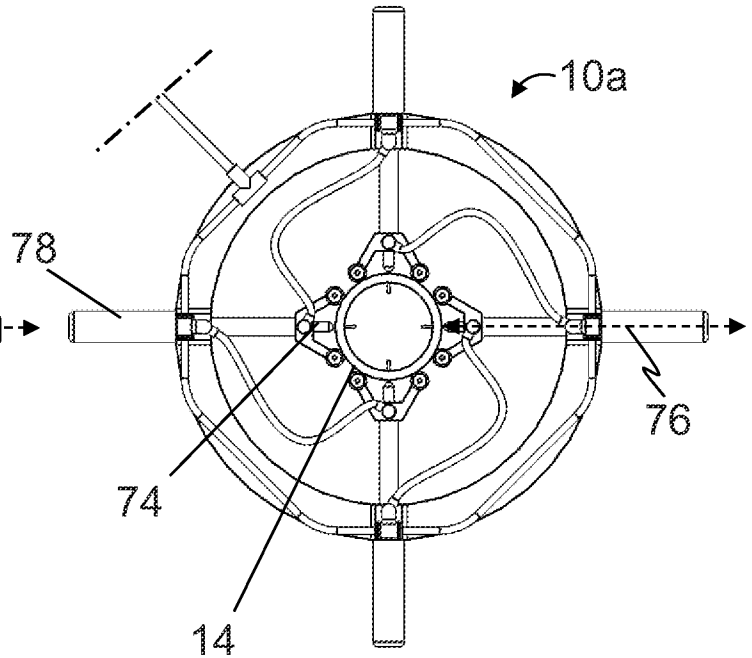
Figure 7B:
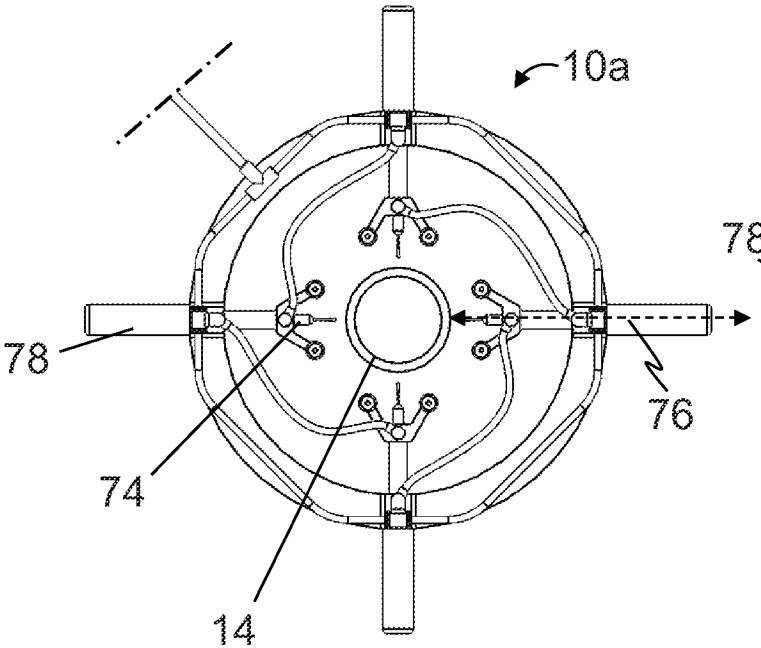
Figure 8:
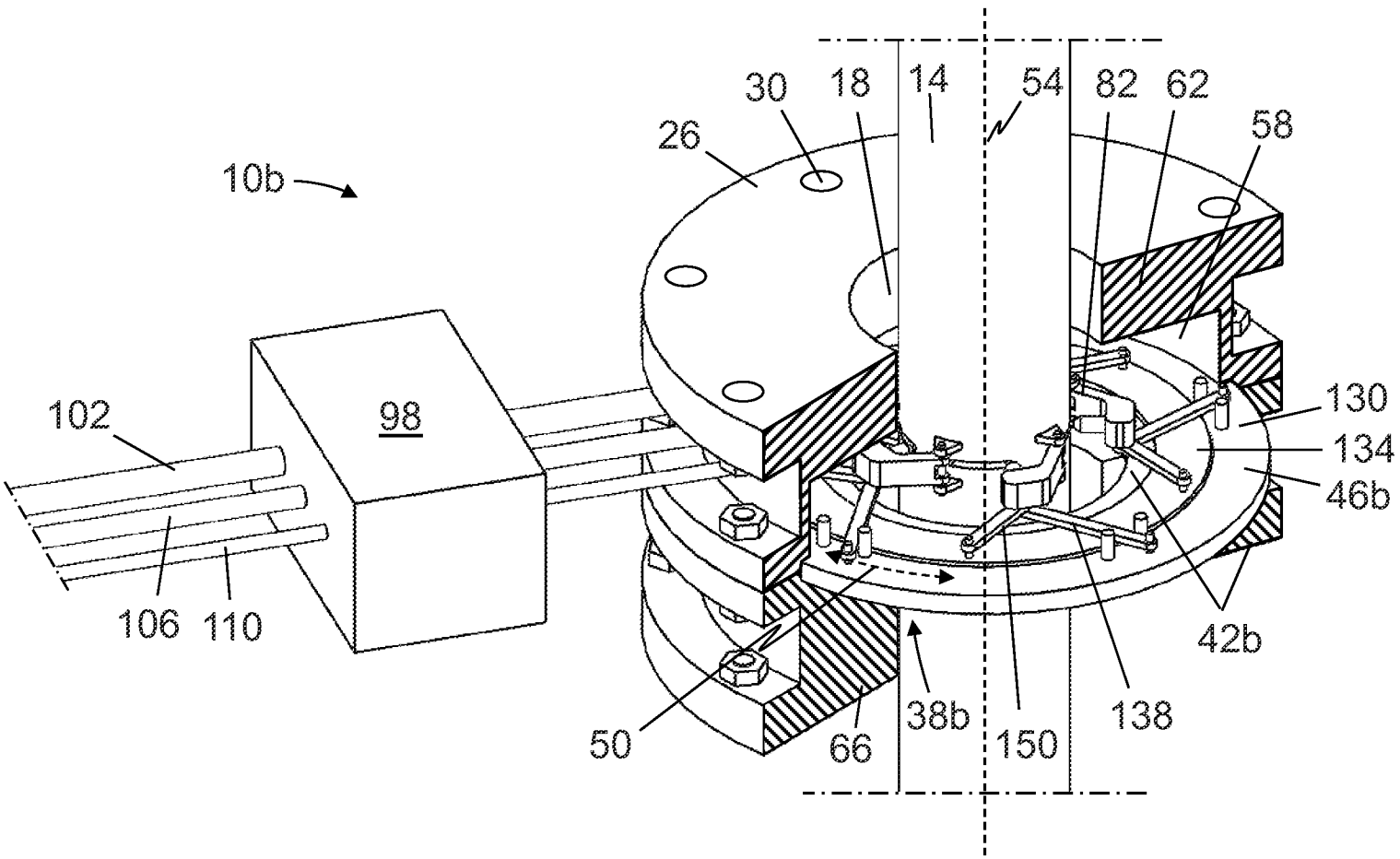
FIG. 8 is a partially cutaway perspective view of a second embodiment of the present subsea pipe cutting apparatuses.
Figure 9:
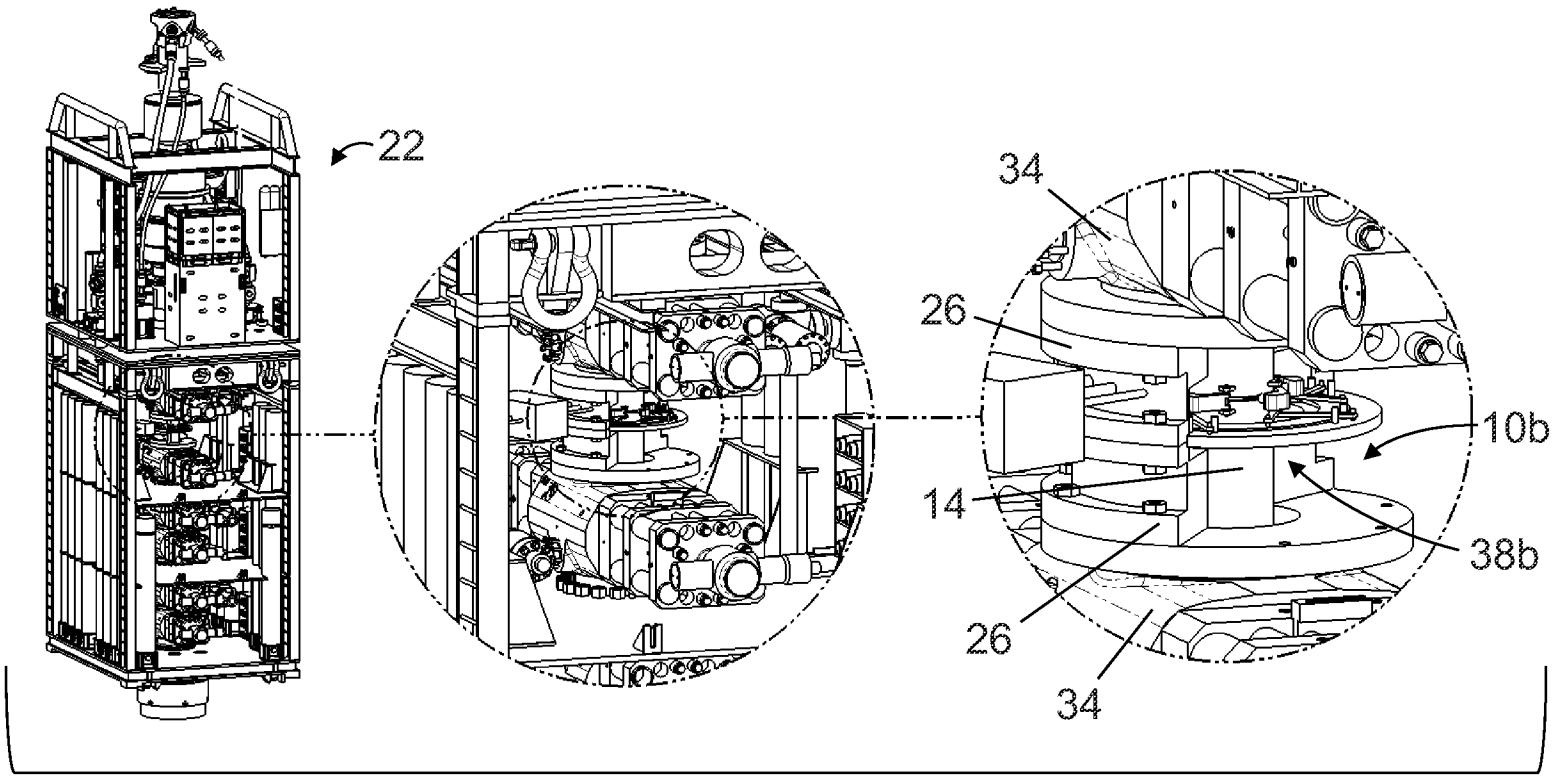
FIGS. 9 and 10 are partially cutaway perspective views of the embodiment of FIG. 8 coupled to a blowout preventer stack.
Figure 10:
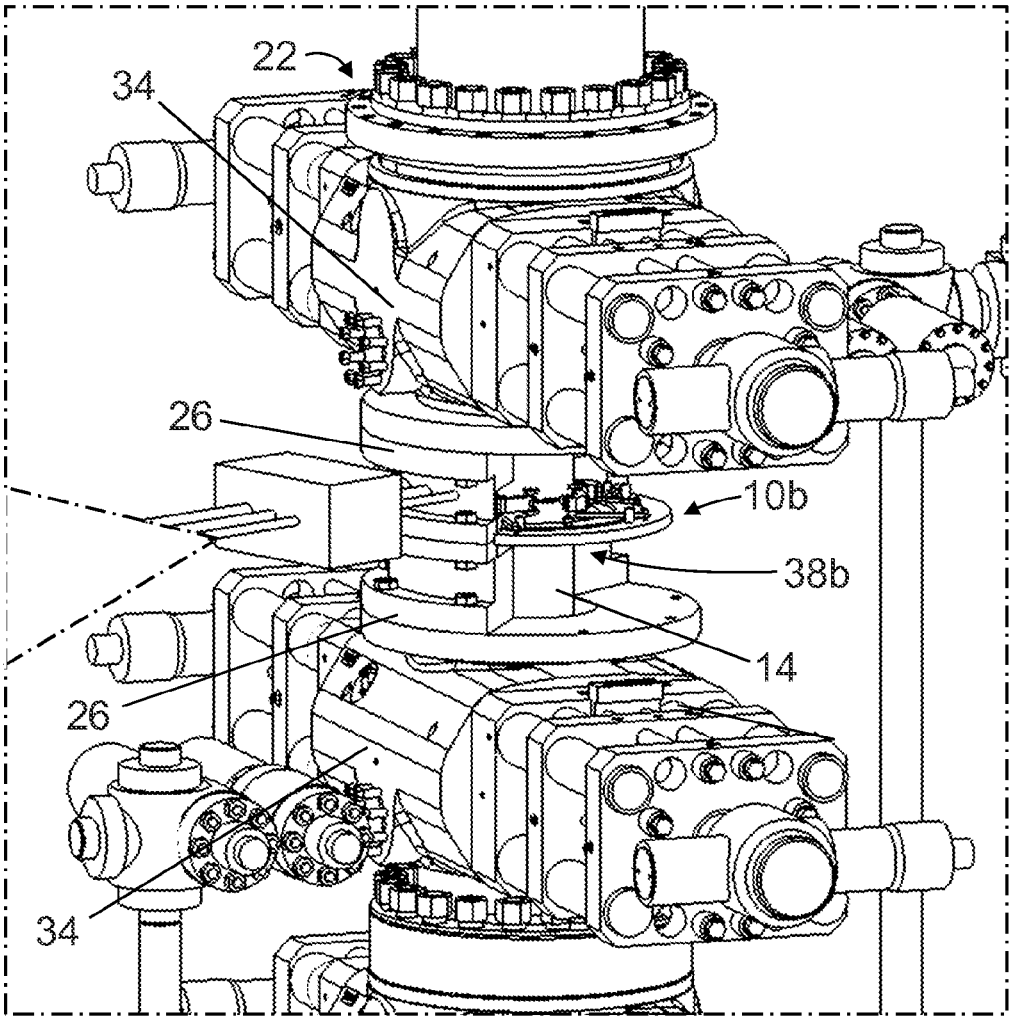
Figure 11:
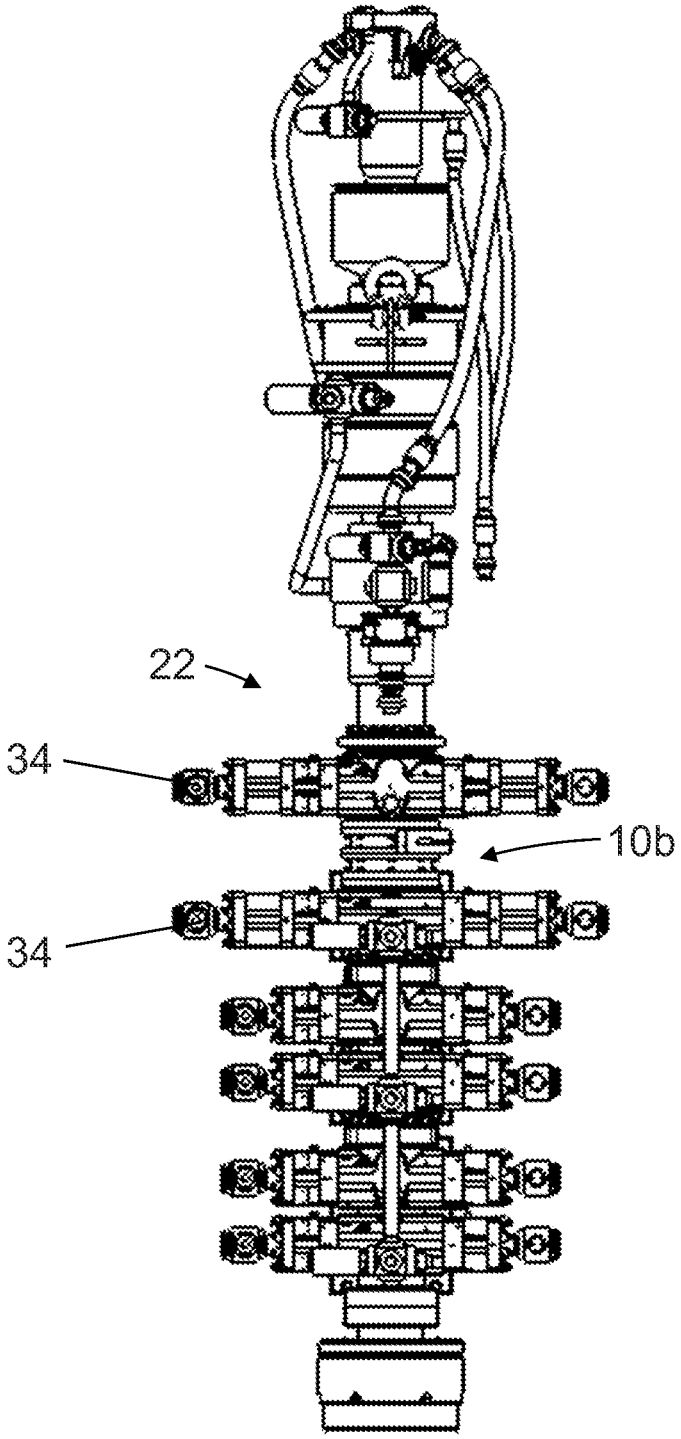
FIGS. 11 and 12 are side views of the embodiment of FIG. 8 coupled to a blowout preventer stack.
Figure 12:
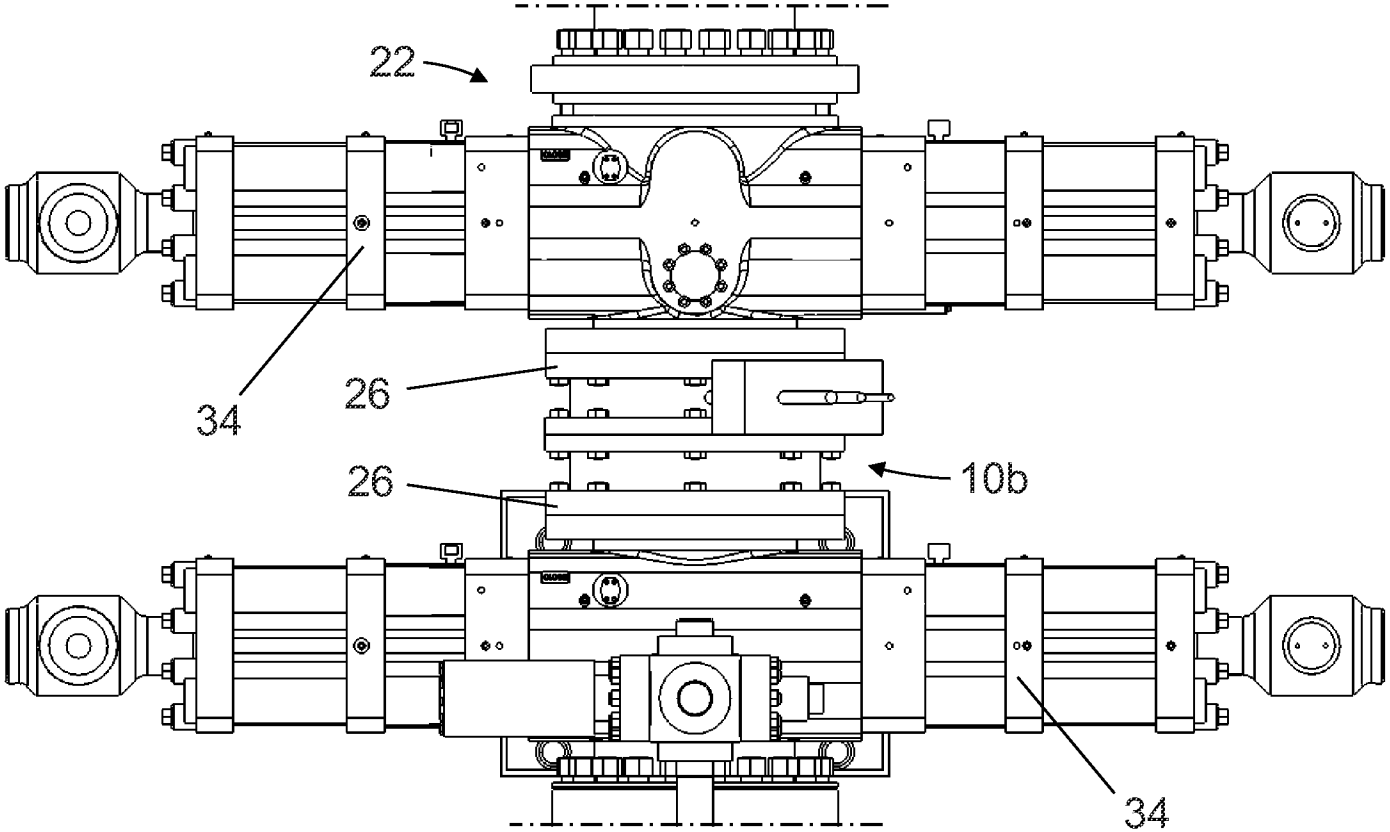
Figure 13A:
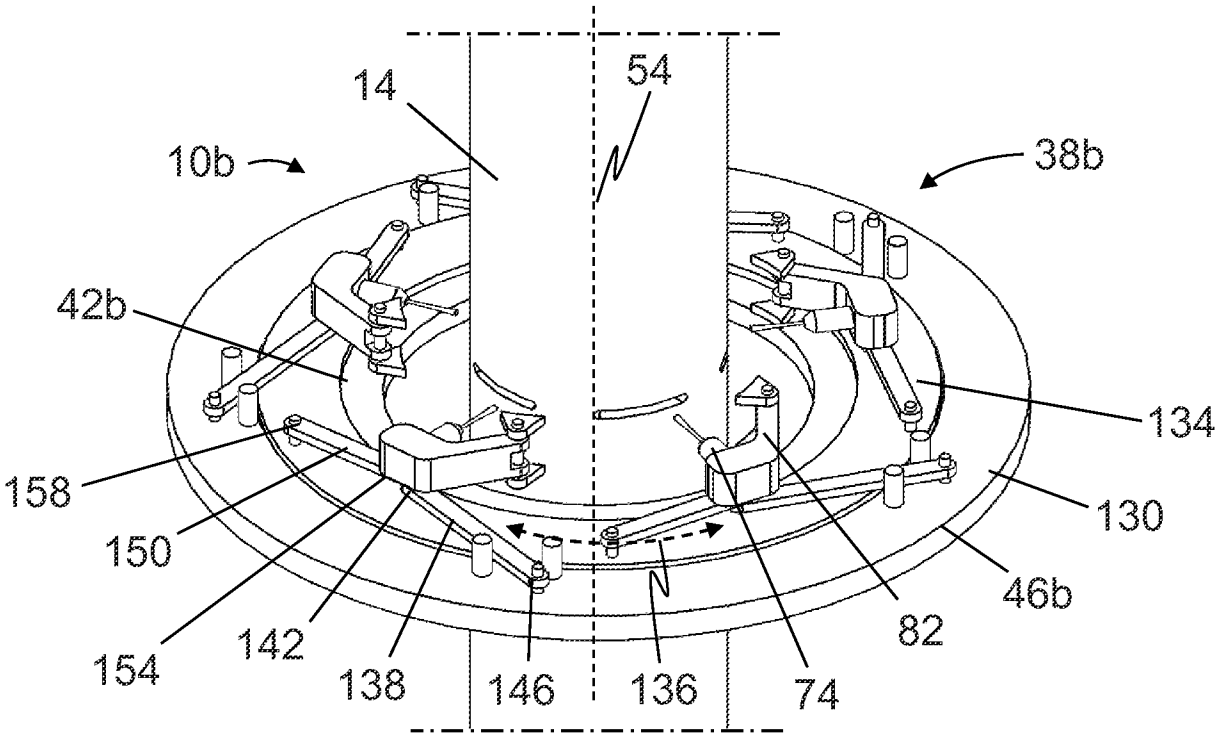
FIGS. 13A-13C are partially cutaway perspective views of the embodiment of FIG. 8, depicting an example of water jet nozzle movement from a retracted state to a deployed state.
Figure 13C:
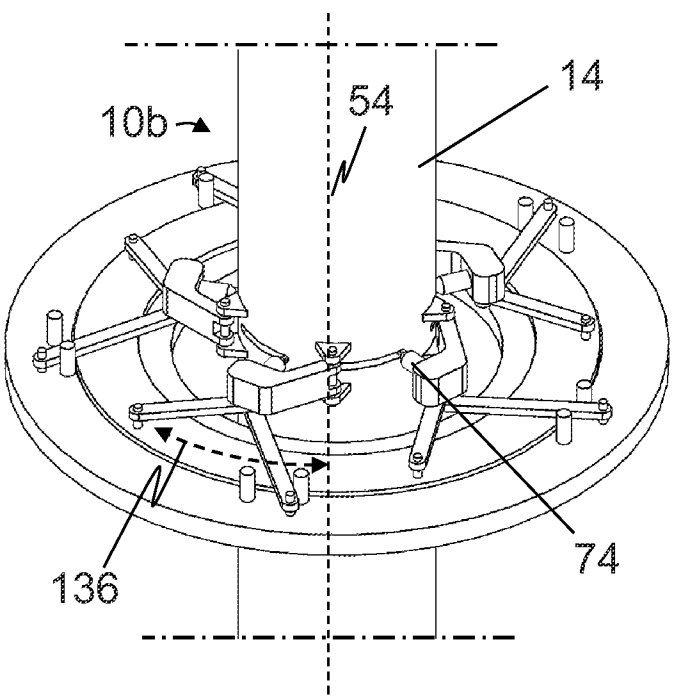
Figure 13B:
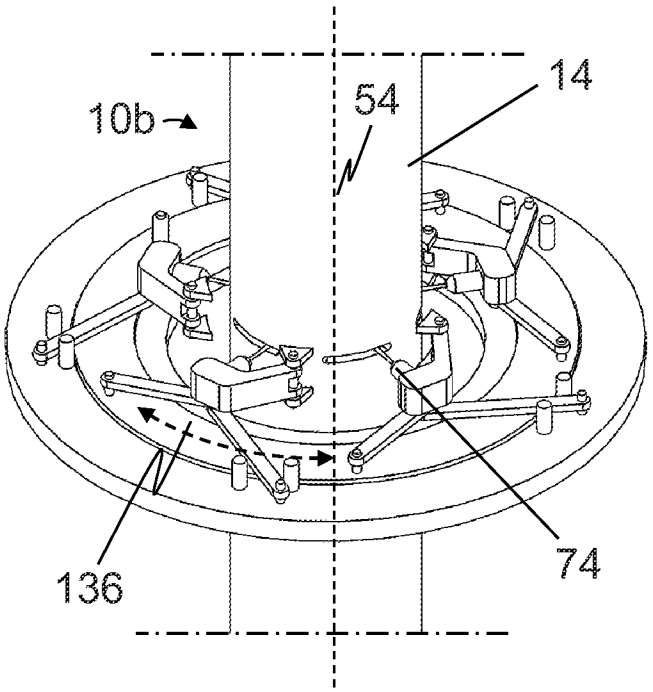
Figure 14A:
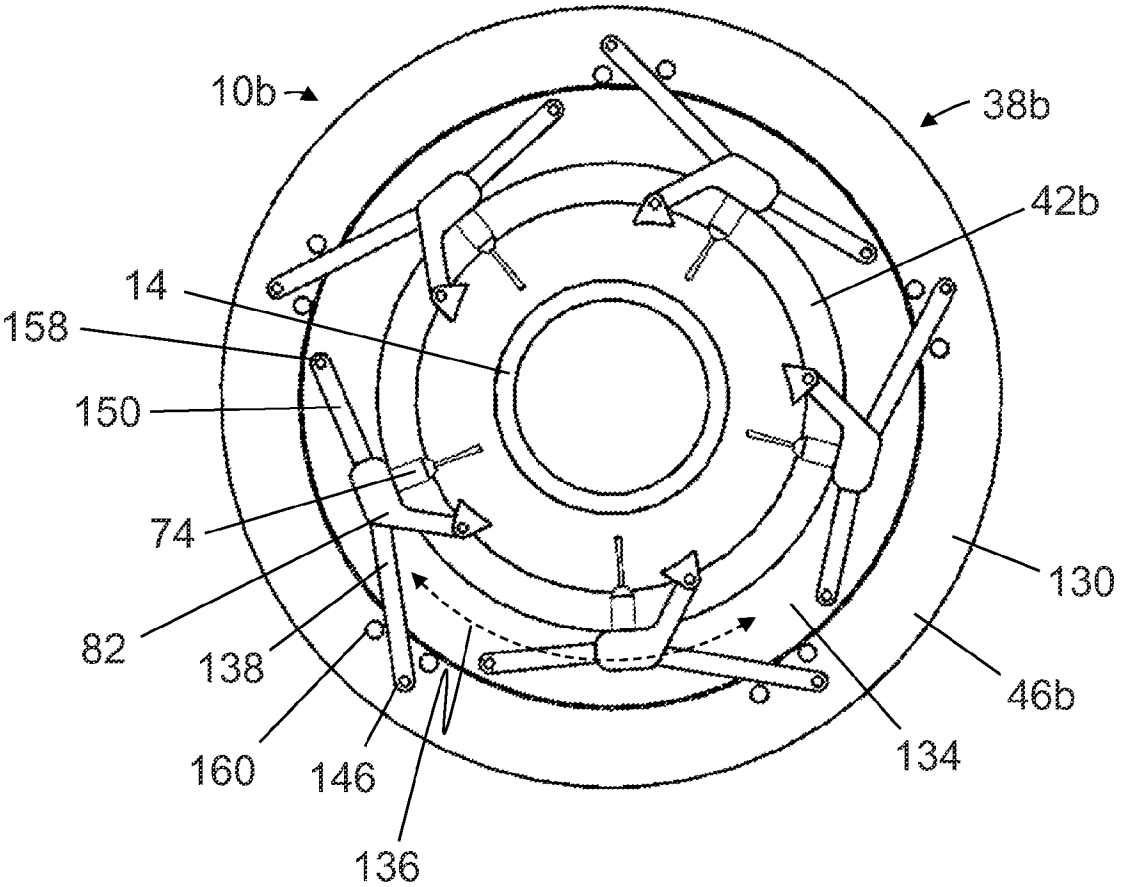
FIGS. 14A-14C are partially cutaway top views of the embodiment of FIG. 8, depicting an example of water jet nozzle movement from a retracted state to a deployed state.
Figure 14C:
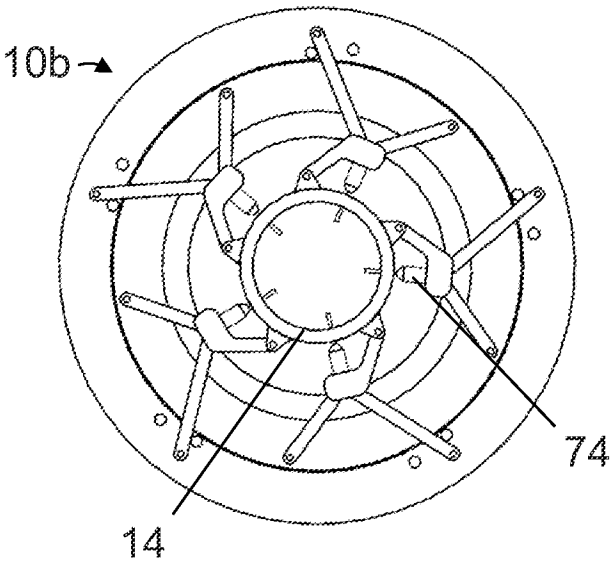
Figure 14B:
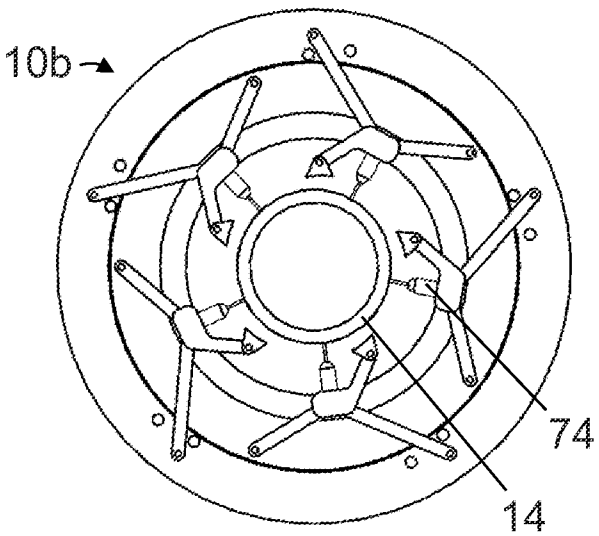

Some embodiments of the present methods for cutting a subsea pipe (e.g., 14) comprise applying pressurized fluid to the pipe with one or more water jet nozzles (e.g., 74) to cut the pipe, where the one or more water jet nozzles are coupled to a frame (e.g., 38*a*, 38*b*), the frame coupled to a blowout preventer stack (e.g., 22) via a flange (e.g., 26). Some methods comprise moving the one or more water jet nozzles from a retracted state (e.g., as shown in FIGS. 6A and 7A and/or as shown in FIGS. 13A and 14A) to a deployed state (e.g., as shown in FIGS. 6C and 7C and/or as shown in FIGS. 13C and 14C) in which the water jet nozzle(s) are radially closer to the pipe than when in the retracted state. Some methods comprise moving the one or more water jet nozzles circumferentially around the pipe. Some methods comprise pivoting the one or more water jet nozzles while applying pressurized fluid to a surface of the pipe.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

ALTERNATIVE OR ADDITIONAL DESCRIPTIONS OF ILLUSTRATIVE EMBODIMENTS

The following alternative or additional descriptions of features of one or more embodiments of the present disclosure may be used, in part and/or in whole and in addition to and/or in lieu of, some of the descriptions provided above.

Some embodiments of the present apparatuses comprise a drill pipe enclosed by a rigid blowout preventer (BOP) housing, one or more hydraulic BOP functions coupled to the rigid BOP housing, and one or more water jets coupled to the rigid BOP housing and positioned around the drill pipe to automatically shear the drill pipe upon command. Some embodiments comprise a drill pipe casing around the drill pipe, wherein the one or more water jets are positioned around the drill pipe casing to automatically shear the drill pipe casing and the drill pipe upon command.

In some embodiments, each one of the one or more hydraulic BOP functions comprises at least one of a ram, an annular, a connector, and a failsafe valve function.

In some embodiments, the one or more water jets are configured to rotate around the drill pipe when the one or more water jets are activated to shear the drill pipe.

In some embodiments, the command to shear the drill pipe is received by at least one of the one or more water jets from at least one of: an operator on an offshore drilling vessel, a hydraulic circuit coupled to the one or more water jets, and an electrical processing device coupled to the one or more water jets.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A pipe cutting apparatus for use in a blowout preventer stack, the pipe cutting apparatus comprising:

a frame comprising a stationary portion defining an interior volume and a rotatable portion disposed within the interior volume;

a flange configured to secure the stationary portion of the frame relative to a blowout preventer stack; and one or more water jet nozzles coupled to the rotatable portion of the frame and configured to apply pressurized fluid to a pipe to cut the pipe, where the one or more water jet nozzles are movable between a retracted state and a deployed state in which the one or more water jet nozzles are radially closer to the pipe than when in the retracted state.

2. The pipe cutting apparatus of claim 1, where actuation of the one or more water jet nozzles causes rotation of the rotatable portion of the frame relative to the stationary portion of the frame.

3. The pipe cutting apparatus of claim 1, where rotation of the rotatable portion of the frame relative to the stationary portion of the frame causes the one or more water jet nozzles to move between the retracted state and the deployed state.

4. The pipe cutting apparatus of claim 3, comprising:

a first linkage having a first end coupled to one of the one or more water jet nozzles and a second end pivotally coupled to the stationary portion of the frame; and a second linkage having a first end coupled to the one of the one or more water jet nozzles and a second end pivotally coupled to the rotatable portion of the frame;

where rotation of the rotatable portion of the frame relative to the stationary portion of the frame causes the first end of the first linkage and the first end of the second linkage to displace radially towards the pipe.

5. The pipe cutting apparatus of claim 1, comprising a reservoir configured to supply an abrasive to at least a portion of the pressurized fluid.

6. A pipe cutting apparatus for use in a blowout preventer stack, the pipe cutting apparatus comprising:

a frame defining an interior passageway configured to receive a pipe;

one or more water jet nozzles coupled to the frame and configured to apply pressurized fluid to the pipe to cut the pipe; and one or more actuators configured to move the one or more water jet nozzles from the retracted state to the deployed state, where the one or more water jet nozzles are movable between a retracted state and a deployed state in which the water jet nozzles are radially closer to the pipe than when in the retracted state.

7. The pipe cutting apparatus of claim 6, where the one or more water jet nozzles are pivotally coupled to the frame such that each of the one or more water jet nozzles can be pivoted while applying pressurized fluid to a surface of the pipe.

8. The pipe cutting apparatus of claim 6, where each of the one or more water jet nozzles comprises a stop configured to contact the pipe when the water jet nozzle is in the deployed state.

9. The pipe cutting apparatus of claim 6, comprising a flange configured to secure the pipe cutting apparatus relative to a blowout preventer stack.

10. The pipe cutting apparatus of claim 6, where the one or more water jet nozzles comprises two or more water jet nozzles.

11. The pipe cutting apparatus of claim 6, where:

the frame comprises a first portion and a second portion configured to rotate relative to the first portion; and the one or more water jet nozzles are coupled to the second portion of the frame.

12. The pipe cutting apparatus of claim 11, where actuation of the one or more water jet nozzles causes rotation of the second portion of the frame relative to the first portion of the frame.

13. The pipe cutting apparatus of claim 11, where rotation of the second portion of the frame relative to the first portion of the frame causes the one or more water jet nozzles to move between the retracted state and the deployed state.

14. The pipe cutting apparatus of claim 13, comprising:

a first linkage having a first end coupled to one of the one or more water jet nozzles and a second end pivotally coupled to the first portion of the frame; and a second linkage having a first end coupled to the one of the one or more water jet nozzles and a second end pivotally coupled to the second portion of the frame;

where rotation of the second portion of the frame relative to the first portion of the frame causes the first end of the first linkage and the first end of the second linkage to displace radially towards the pipe.

15. A method for cutting a pipe, comprising:

applying pressurized fluid to the pipe with one or more water jet nozzles to cut the pipe; and moving the one or more water jet nozzles between a retracted stated and a deployed state in which the water jet nozzles are radially closer to the pipe then when in the retracted state, wherein one or more actuators are configured to move the one or more water jet nozzles from the retracted state to the deployed state; and where the one or more water jet nozzles are coupled to a frame, the frame coupled to a blowout preventer stack via a flange.

16. The method of claim 15, comprising moving the one or more water jet nozzles circumferentially around the pipe.

17. The method of claim 15, comprising pivoting the one or more water jet nozzles while applying pressurized fluid to a surface of the pipe.

* * * * *